United States Patent [19]

Dellas

[11] 4,020,520

[45] May 3, 1977

[54] HANDLE FOR PAINT BRUSHES AND THE LIKE

[76] Inventor: Nick Dellas, 8613 E. Valley Vista Drive, Scottsdale, Ariz. 85253

[22] Filed: Sept. 15, 1975

[21] Appl. No.: 613,285

[52] U.S. Cl. ..... 15/176; 15/143 B

[51] Int. Cl.[2] ..... A46B 5/02

[58] Field of Search ..... 15/143 R, 159 R, 160, 15/167 B, 236 R, 104 S, 143 B, 144 B, 145, 146, 176; 17/19, 66; 401/8; D4/37–39; D7/181, 183

[56] References Cited

UNITED STATES PATENTS

| | | | |
|---|---|---|---|
| 630,844 | 8/1899 | Barratt | 15/160 |
| 1,850,090 | 3/1932 | Alexander | 30/340 UX |
| 1,931,926 | 10/1933 | Johnson et al. | 30/169 |
| D34,272 | 3/1901 | Hoffman | 30/169 X |
| D169,673 | 5/1953 | Horton | D4/23 |
| D196,959 | 11/1963 | Huch | D4/23 |

FOREIGN PATENTS OR APPLICATIONS

| | | | |
|---|---|---|---|
| 924,051 | 2/1955 | Germany | 15/245 |
| 53,045 | 2/1932 | Norway | 30/169 |

*Primary Examiner*—Daniel Blum
*Attorney, Agent, or Firm*—Warren F. B. Lindsley

[57] ABSTRACT

A handle for a paint brush, scraper, dust pan or the like wherein the fingers of the hand extend through a suitable opening in the handle so as to support the handle by the wrist of the user, thereby utilizing the arm of the user more effectively as an integral part of any painting, scraping or cleaning action of the tool.

1 Claim, 5 Drawing Figures

HANDLE FOR PAINT BRUSHES AND THE LIKE

BACKGROUND OF THE INVENTION

Brushes, scrapers and the like are implements for aiding in the sweeping of dirt, scraping of surfaces and the laying on of liquids in thin layers such as painting. Their handles have merely been gripping surfaces usually designed for ease in holding but without much thought to eliminating fatigue or utilizing the arm of the user more effectively in the brushing, scraping or painting action.

PRIOR ART

Attempts have been made to provide more comfortable hand gripping means for paint brushes and the like for reducing or avoiding fatigue in their use as evident from U.S. Pat. No. 2,914,785 which discloses a saw like handle for a paint brush. This handle is not satisfactory since most of the action is generated from wrist movement which is highly fatiguing.

U.S. Pat. No. Des 169,673 merely discloses a handle design wherein an opening through the handle for the fingers leaves the wrist of the user unsupported.

U.S. Pat. No. 3,153,252 merely discloses a telescoping hollow body member formed into a plurality of sections employing an expandable spring member disposed within the body member for use on brooms, mops or the like.

SUMMARY OF THE INVENTION

None of the known prior art discloses an implement handle for supporting the wrist of the user and integrating the arm of the user more effectively in its use.

Since wrist action is fatiguing the prior art devices fail to accomplish the goals of the claimed invention.

It is, therefore, one object of this invention to provide a new and improved implement handle.

Another object of this invention is to provide an improved implement handle with comfortable hand gripping and wrist supporting means for avoiding or materially reducing fatigue.

A further object of this invention is to provide an improved handle for a paint brush which permits the fingers to extend through a selectively positioned aperture in the handle causing the wrist of the user to engage and support the handle integrating the arm of the user in brush movements.

A still further object of this invention is to provide an improved handle as claimed which may be readily supplemented for the handle of existing paint brushes or the like.

A still further object of this invention is to provide such a handle that is relatively inexpensive to manufacture and can be readily connected to the brush parts used therewith.

A still further object of this invention is to provide an improved handle as claimed which may be used with either hand.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing in which.

DESCRIPTION OF THE PREFERRED EMBODIMENT

Figure 1:
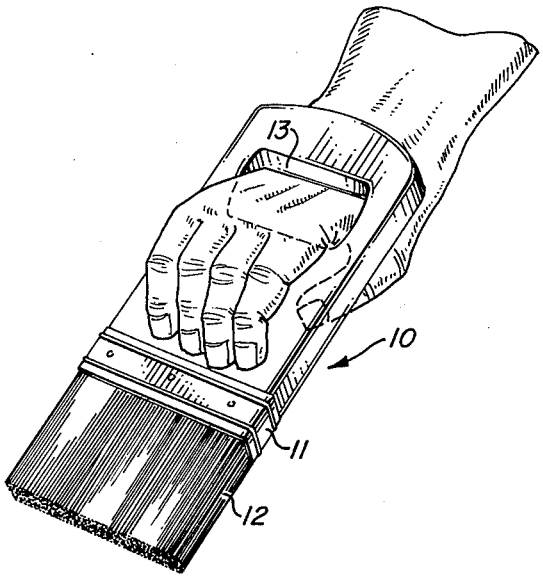
FIG. 1 is a perspective view of a first embodiment illustrating a paint brush employing the disclosed handle and showing a user's hand in place.
Figure 5:
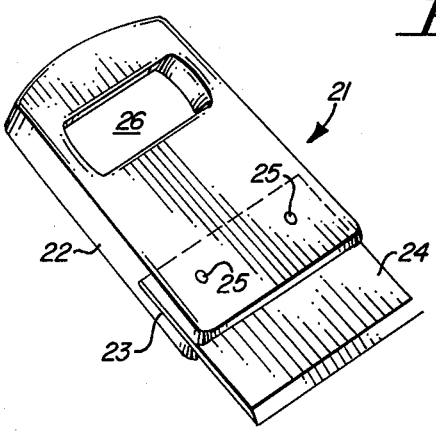
FIG. 5 is a perspective view of a further modification of the implement shown in FIG. 1 illustrating the disclosed handle on a scraper.

Referring more particularly to the drawing by characters of reference, FIG. 1 discloses the claimed handle 10 which may be hollow or solid and made of wood, plastic, rubber composition or other suitable material attached to the usual holding sheath 11 for gripping the bristles portion 12 of the brush. Although the implement may be a paint brush or a scraper blade 13, as shown in FIG. 5, bristles of a broom may be used with it. The bristles of the paint brush shown in FIG. 1 may be obtained from hogs, or vegetable, wood or plastic fiber material may be used and are not a limiting part of this invention.

As shown in FIGS. 1, 2, 4 and 5, the handle of the implement may be screwed, nailed or riveted through the sheath to the implement such as the bristles, scraper and the like. The sheath may be fastened to the implement by suitable cement or glue if so desired and falls within the scope of this invention.

In accordance with the invention claimed, the handle 10 comprises an elongated rectangular configuration which may be, for example, ten inches long from the tip of the handle to the sheath 11 having an opening 13 arranged at the end of the handle opposite from the sheath to extend therethrough for receiving the first four fingers and the palm and back of the hand, as shown in FIG. 1. This opening may extend from a few inches of that end of the handle along the length of the handle a distance of approximately two and three quarters of an inch. Such an opening may be penetrated and the implement used by either the right or left hand of the user.

One useful handle width is four inches which is satisfactory for use on a four inch brush or scraper.

Figure 2:
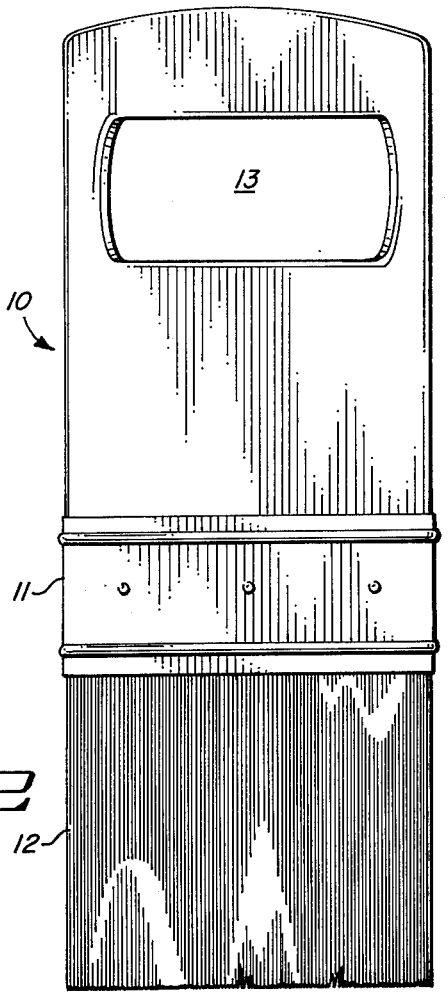
FIG. 2 is a front view of the handle.
Figure 3:
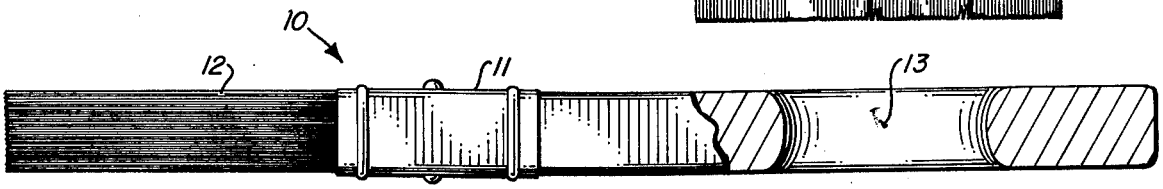
FIG. 3 is an end view of FIG. 2 partially broken away.
Figure 4:
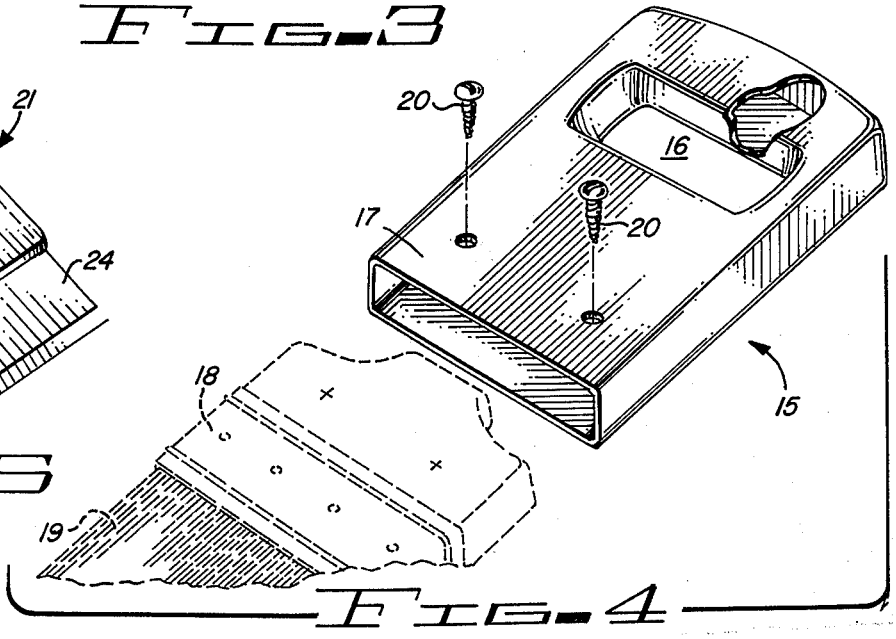
FIG. 4 is an exploded partial view showing the preferred modification of the mounting arrangement of the claimed handle on an existing bristle portion of a paint brush.

FIG. 4 illustrates the preferred modification of the handle shown in FIGS. 1–3 wherein a hollow handle 15 is provided with an opening 16 at one end which is similar to opening 13 of handle 10. The end 17 of the handle is arranged to fit over the handle of a brush and if so desired over at least a part of sheath 18 which is fastened around the bound end of a bristle assembly 19. Suitable screws, rivets, pins 20 or the like may be used to fasten the handle to the bristle assembly.

FIG. 5 illustrates a further implement 21 wherein a handle 22 similar to handle 10 of FIG. 1 is slotted at one end to receive the fastening end 23 of a scraper blade 24. Blade 24 is secured in the slotted end of the handle by pins 25 or any other suitable means.

The opening 26 at the non-implement engaging end of the device is similar to that described for the structure shown in FIGS. 1, 2 and 4 and for that reason will not be discussed further.

Although but a few embodiments of the present invention have been illustrated and described, it will be apparent to those skilled in the art that various changes and modifications may be made therein without departing from the spirit of the invention or from the scope of the appended claim.

What is claimed is:

1. A paint brush comprising:

an elongated hollow handle member engaging at one end a brush and at the other end engageable by the hand of a user, said other end being provided with a first opening extending therethrough large enough to receive the first four fingers and palm and back of the hand with the fingers capable of extending longitudinally of said member toward said other end of said handle member and the palm and back of the hand engaging the periphery of said first opening, said first opening being of a substantially rectangular configuration extending laterally across the longitudinal axis of said handle member, gripping means arranged at said other end of said member for grasping a brush comprising a second opening extending longitudinally into said one end of said handle member, whereby said handle member is arranged to fit over the handle end of a brush, means extending through said one end of said handle member to fasten said brush to the handle member, said handle member being substantially ten inches in length and four inches in width and said first opening being approximately two and three quarters inches wide in a direction extending along the length of said handle member.

* * * * *